US006847790B2

(12) United States Patent
Kobayashi et al.

(10) Patent No.: US 6,847,790 B2
(45) Date of Patent: Jan. 25, 2005

(54) COLOR IMAGE FORMING APPARATUS

(75) Inventors: Tatsuya Kobayashi, Shizuoka (JP); Takashi Shibuya, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/607,310

(22) Filed: Jun. 27, 2003

(65) Prior Publication Data

US 2004/0004654 A1 Jan. 8, 2004

(30) Foreign Application Priority Data

Jul. 8, 2002 (JP) ..... 2002-199016

(51) Int. Cl.[7] ..... G03G 15/00

(52) U.S. Cl. ..... 399/49; 399/50; 399/51; 399/53

(58) Field of Search ..... 399/38, 40, 46, 399/48, 49, 50, 51, 53

(56) References Cited

U.S. PATENT DOCUMENTS

| | | | | |
|---|---|---|---|---|
| 5,579,090 A | * | 11/1996 | Sasanuma et al. | 399/49 |
| 5,666,588 A | | 9/1997 | Uchiyama et al. | 399/44 |
| 5,873,010 A | | 2/1999 | Enomoto et al. | 399/39 |
| 5,940,654 A | | 8/1999 | Uchiyama et al. | 399/49 |
| 6,125,245 A | | 9/2000 | Shibuya et al. | 399/49 |
| 6,246,844 B1 | * | 6/2001 | Shiba | 399/49 |
| 6,771,911 B2 | * | 8/2004 | Ko | 399/27 |

* cited by examiner

*Primary Examiner*—Hoan Tran
(74) *Attorney, Agent, or Firm*—Fitzpatrick, Cella, Harper & Scinto

(57) ABSTRACT

A color image forming apparatus includes a controlling unit for controlling an exposure unit, developing devices, etc., so that an ordinary image of one color is formed within a period of time in which a carrier rotates once, and density detection pattern images of a plurality of colors are formed within the period of time in which the carrier rotates once.

22 Claims, 6 Drawing Sheets

COLOR IMAGE FORMING APPARATUS

BACKGROUND OF THE INVENTION

1. Field of the Invention

The present invention relates to a color image forming apparatus.

2. Description of the Related Art

Hitherto, a technology in which toner images are successively formed on a surface of a photosensitive member by rotating developing devices that are provided for four colors (yellow, magenta, cyan, and black), and in which the toner images are transferred onto a carrier, such as a transfer material holder or an intermediate transfer member, by successively superimposing them upon each other is known as a technology used in a color image forming apparatus which makes use of an electrophotographic process.

In the color image forming apparatus, since the images of four colors are successively formed by rotating the developing devices so that one color is switched to the next color each time the carrier rotates once, it is necessary to rotate the carrier four times in order to form one full-color image.

Hitherto, in the color image forming apparatus, when density/tone controlling operations (hereinafter simply referred to as "density controlling operations") are carried out, density control patterns of the corresponding colors are formed. Since, in the density controlling operations, a developing device is switched to another developing device every time the carrier rotates once, the density controlling operations take the time required for the carrier to rotate four times.

SUMMARY OF THE INVENTION

Accordingly, it is an object of the present invention to make it possible to overcome the aforementioned problems.

To this end, according to a first aspect of the present invention, there is provided a color image forming apparatus comprising an image forming unit for forming an image of any of a plurality of colors; a carrier for carrying the image formed by the image forming unit; and a density detector adapted for detecting the density of the image on the carrier; and a controlling unit adapted for controlling the image forming unit so that density detection pattern images of different colors included in the any of the plurality of colors for detection by the density detector are formed within a period of time in which the carrier rotates once.

According to another aspect of the present invention, there is provided a color image forming apparatus comprising an image forming unit for forming an image of any of a plurality of colors; a carrier for carrying the image formed by the image forming unit; and a density detector adapted for detecting the density of the image on the carrier; and a controlling unit adapted for switching between colors in the image forming unit in a period of time that is different from a period of time in which an ordinary image is formed, when a density detection pattern image for detection by the density detector is to be formed.

Further objects, features and advantages of the present invention will become apparent from the following description of the preferred embodiments with reference to the attached drawings.

DESCRIPTION OF THE PREFERRED EMBODIMENTS

Figure 1:
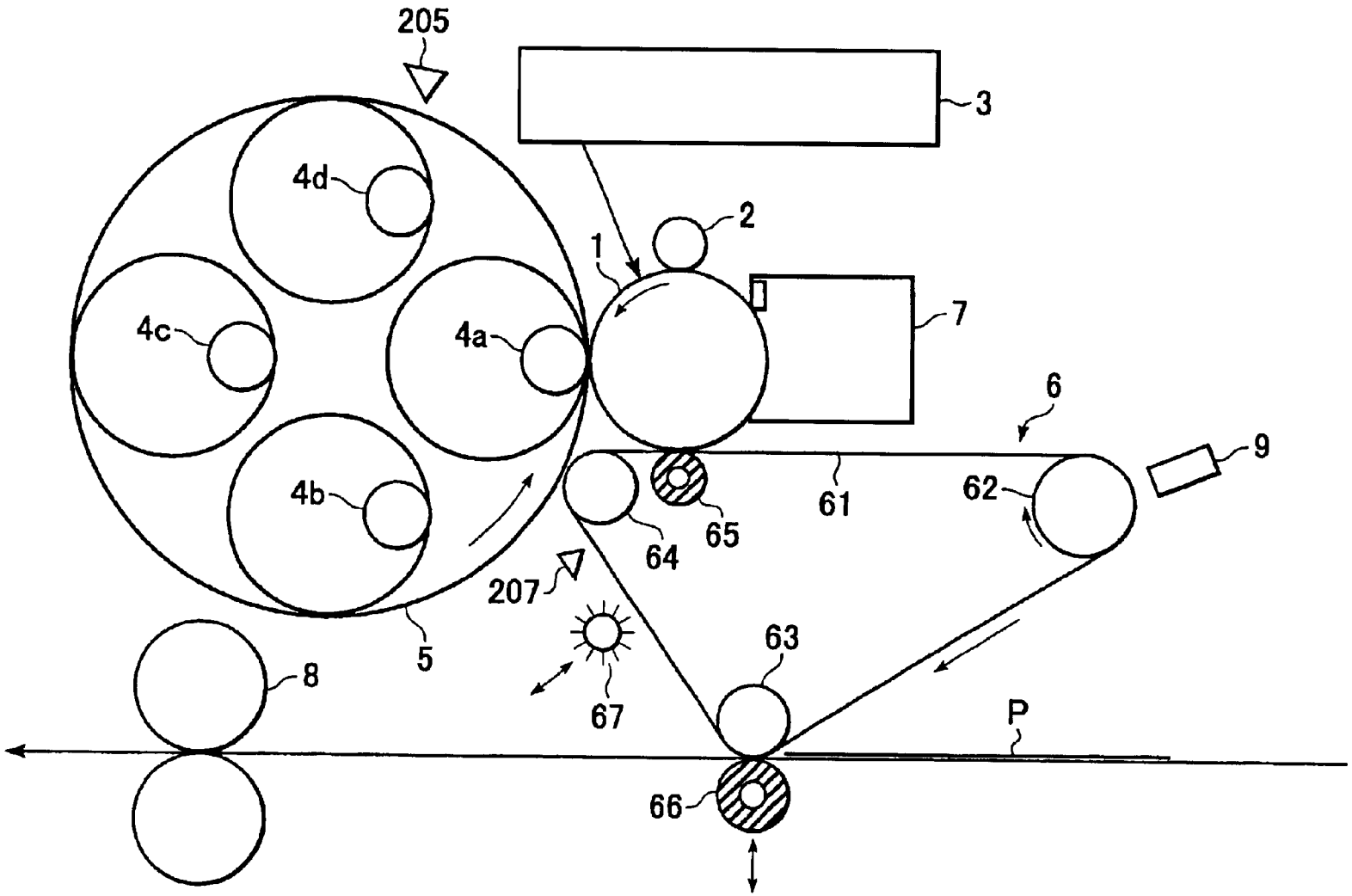
FIG. 1 is a sectional view of a color image forming apparatus of a first embodiment of the present invention.

FIG. 1 illustrates a full-color image forming apparatus of a first embodiment of the present invention. A photosensitive drum 1 is driven by driving means (not shown) in the direction of an arrow marked on the photosensitive drum 1 in FIG. 1 and is uniformly charged to a predetermined voltage by a roller charger 2. The photosensitive drum 1 is an electrostatic latent image carrier comprising an aluminum cylinder having an organic photosensitive material (OPC) or a photoconductive material (such as A—Si, CdS, or Se) applied to the outer peripheral surface thereof. Next, an exposure device 3 scans the photosensitive drum 1 using light that is based on a signal that is generated in accordance with a yellow image pattern in order to form a latent image on the photosensitive drum 1. When the photosensitive drum 1 rotates further in the direction of the arrow, a supporter 5 rotates so that, of developing devices 4*a*, 4*b*, and 4*c*, which are supported by the supporter 5, the developing device 4*a* containing yellow toner opposes the photosensitive drum 1. Then, the latent image is made visible by the selected developing device 4*a*. The developed toner image is transferred onto an intermediate transfer member 6. In the intermediate transfer member 6, a transfer belt 61 (formed of rubber, such as EPDM, NBR, urethane rubber, or silicone rubber) is placed around three rollers, that is, a driving roller 62, a driven roller 63, and a tension roller 64. By rotating the driving roller 62 by a motor (described later) in the direction of an arrow marked beside it in FIG. 1, the transfer belt 6 is driven in the direction of an arrow marked beside it in FIG. 1. A first transfer roller 65 having an electrically conductive sponge layer disposed on an axis thereof is in contact with the photosensitive drum 1 through the transfer belt 61. A bias voltage is applied to the first transfer roller 65 from a high-voltage power supply (not shown) in order to transfer the toner image formed on the photosensitive drum 1 onto the transfer belt 61.

By carrying out the above-described operations to form magenta, cyan, and black images, toner images of a plurality of colors are formed on the transfer belt 61. A position detector (not shown) is disposed at an end of the transfer belt 61. By reading positions detected by the position detector using an optical sensor or the like, position reference signals are formed in order to align the toner images on the transfer belt 61.

Figure 2:
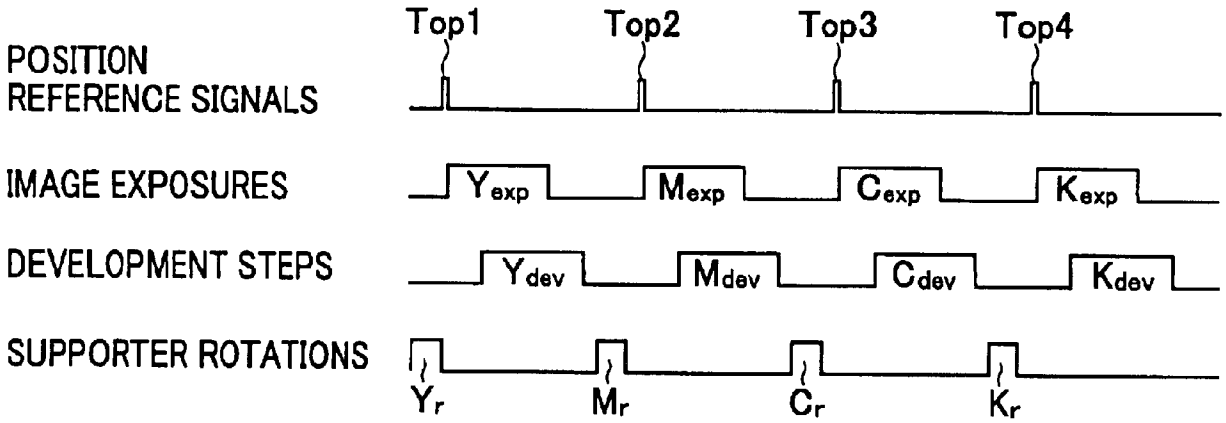
FIG. 2 illustrates an image formation sequence when forming an ordinary image.

FIG. 2 shows an image formation sequence in terms of position reference signals, image exposures, development steps, and rotations of the supporter 5, when forming an ordinary image.

Here, the position detector is disposed at one end of the transfer belt 61, and a position reference signal is detected once every time the transfer belt 61 rotates once. When a position reference signal of a first color (Top 1 in FIG. 2) is detected, a first color or yellow image exposure (image exposure Yexp) is carried out. When the exposure position of the photosensitive drum 1 reaches a development position, a yellow development step (Ydev) is carried out by the yellow developing device 4*a*. When the image exposure position of the photosensitive drum 1 passes the development position, the supporter 5 rotates so that a second color or magenta developing device, that is, the developing device 4*b* opposes the development position (supporter rotation Mr). Thereafter, the same image formation sequence is carried out to form an image of the second color, etc., in order to form the images of the four colors. As described above, the operations for forming an image of one color is carried out every time the transfer belt 61 rotates once.

When the toner images of the four colors are transferred onto the transfer belt 61, a transfer material P that is in synchronism with the movement of the transfer belt 61 is transported. A second transfer roller 66 having a structure that is similar to that of the first transfer roller 65 comes into contact with the transfer belt 61 through the transfer material P, and has a bias voltage applied thereto from a high-voltage power supply (not shown), so that the toner images of the four colors on the transfer belt 61 are transferred onto the transfer material P. The toner images of the four colors transferred on the transfer material P are fused and fixed by a related fixing device 8 that heats and presses the images, thereby forming a color image.

A portion of any toner image remaining on the photosensitive drum 1 after transferring the toner images is cleaned off by a cleaner 7 or a related blade means. A portion of any toner image remaining on the transfer belt 61 after transferring the toner images is similarly cleaned off by a cleaner 67, such as a fur brush or a web, that can come into contact with and separate from the transfer belt 61.

Figure 3:
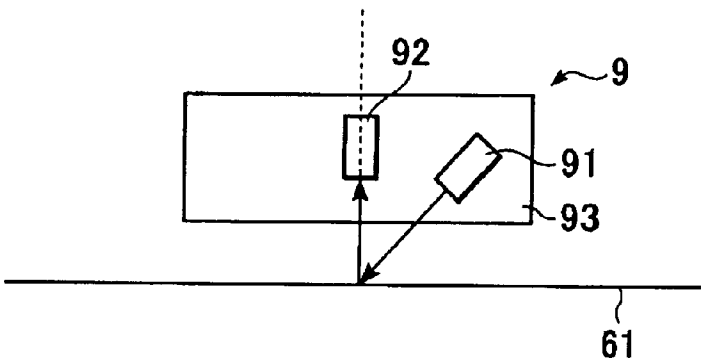
FIG. 3 is a schematic view of a density sensor.

Reference numeral 9 denotes a density sensor. As shown in FIG. 3, it comprises, for example, a light emitter 91, such as a light-emitting diode, a light receiver 92, such as a phototransistor or a photodiode, and a holder 93. Using the density sensor 9, the density of density measurement image patterns formed on the transfer belt 61 is measured in order to carry out density/tone controlling operations. A density controlling operation is carried out to control processing conditions, such as development bias and charging voltage and exposure amount of the photosensitive drum. A tone controlling operation is carried out to control image signals.

In the density/tone controlling operations, density/tone control toner images of two colors are formed during one rotation of the transfer belt 61.

Figure 4:
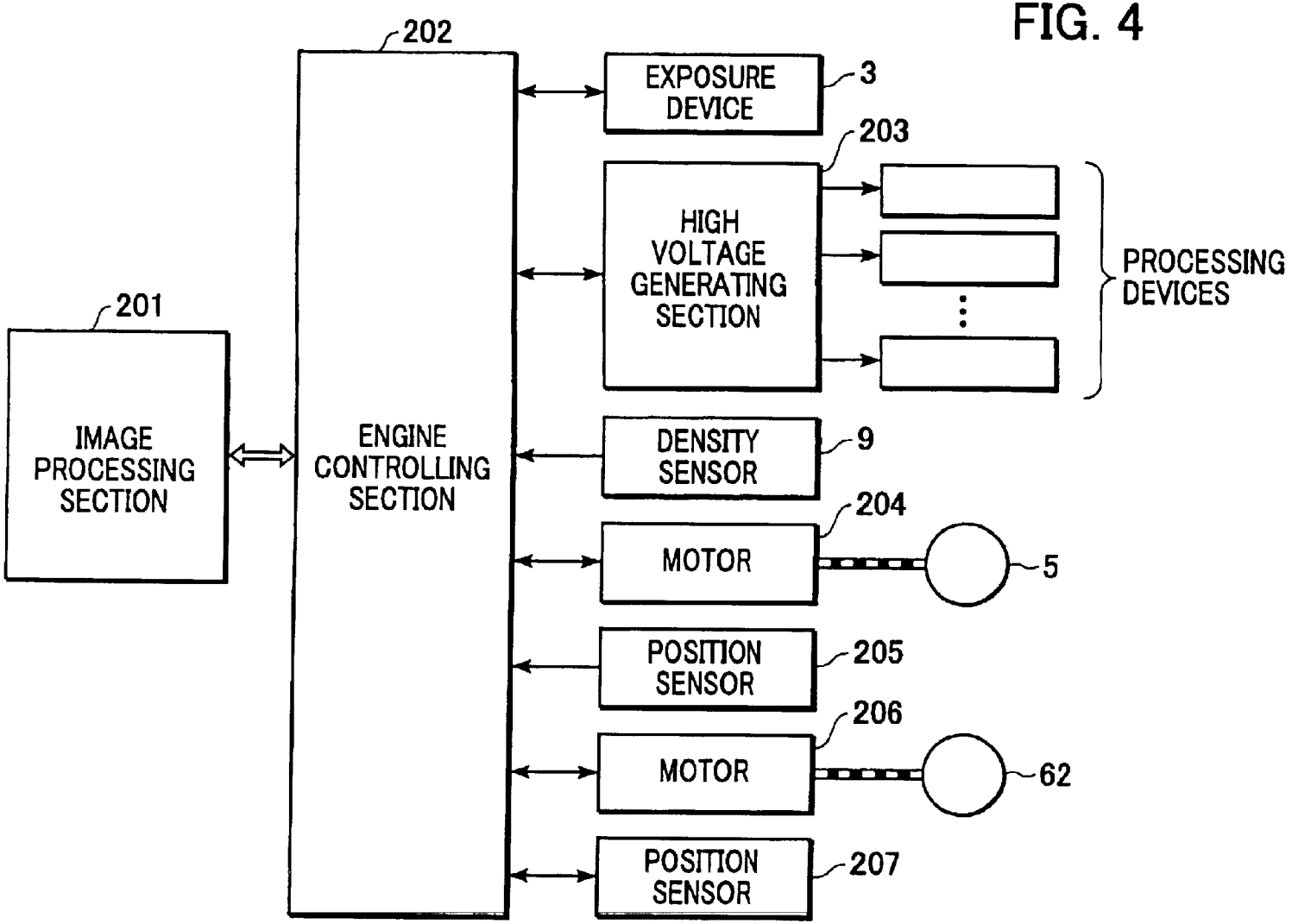
FIG. 4 illustrates a controlling system used in the first embodiment of the present invention.

FIG. 4 shows a controlling system used in the first embodiment.

In FIG. 4, reference numeral 201 denotes an image processing unit for generating image and density measurement pattern information used for forming an image by an image forming apparatus.

Reference numeral 202 denotes an engine controlling unit for controlling the main portion of the color image forming apparatus.

Reference numeral 203 denotes a high pressure generating unit for generating and providing a high pressure required at the above-described various processing devices, such as the charger, the developing devices, and the transfer member.

Reference numeral 204 denotes a motor for changing color as a result of changing the developing device that contacts the photosensitive drum 1 by rotationally driving the supporter 5. Reference numeral 205 is a position sensor for detecting the rotational position of the supporter 5. Based on a detection result output from the position sensor 205, the controlling unit 202 controls the driving of the motor 204 in order to bring the developing device containing tone of the desired color into contact with the photosensitive drum 1.

Reference numeral 206 denotes a motor for rotationally moving the transfer belt 106 by rotationally driving the roller 62. Reference numeral 207 denotes a position sensor for detecting the rotational position of the transfer belt 6 by reading a flag on the transfer belt 6. The controlling unit 202 controls, for example, a timing of image exposure by the exposure device 3 based on a detection result output from the position sensor 207.

The engine controlling unit 202 controls the photosensitive drum 1, a transportation roller for transporting the transfer material, and, for example, a motor or a solenoid (not shown) for driving various devices.

Figure 5:
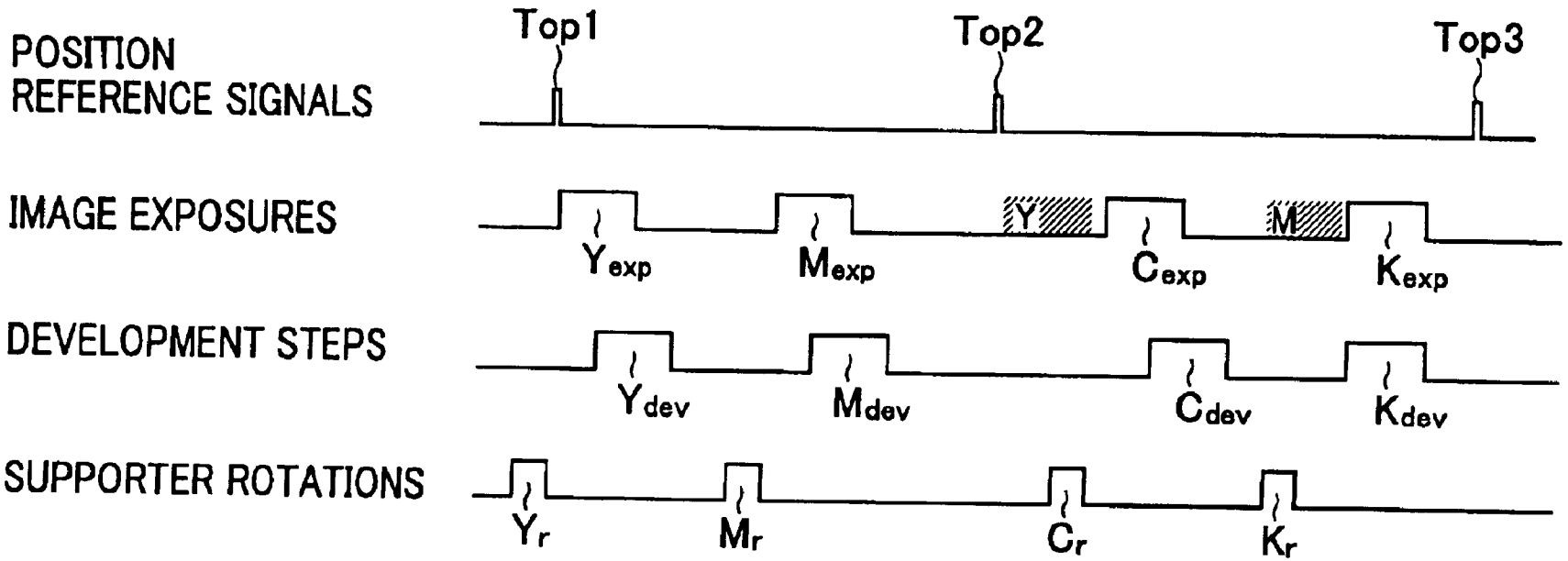
FIG. 5 illustrates an image formation sequence when forming a density control pattern.

FIG. 5 illustrates an image formation sequence in terms of position reference signals of the transfer belt 61, image exposures, development steps, and rotations of the supporter 5 when forming a density/control pattern. The image formation sequence is the most distinctive feature of the embodiment. When a position reference signal (Top 1 in FIG. 5) of the transfer belt 61 is detected, a first-color or yellow density/tone control image exposure (image exposure Yexp) is carried out in order to carry out a development step using yellow toner (development step Ydev). Here, a density measurement image pattern is shorter than the maximum length of an ordinary image. By rotating the supporter 5 after the development using yellow toner (supporter rotation Mr), the developing device containing yellow toner is switched to the developing device containing magenta toner, so that a second-color or magenta density/tone control image exposure (image exposure Mexp) is carried out in order to carry out a development step using magenta toner (development step Mdev). Although depending upon the density sensor used, it is desirable for one density measurement image pattern image to have a size of the order of from 5 mm×5 mm to 15 mm×15 mm. As regards the density controlling operations, it is necessary to have a plurality of density measurement image patterns having different printing conditions, such as charging voltages, exposure amounts, and development biases. Here, it is sufficient to have three to five images having different printing conditions. As regards the tone controlling operations, it is necessary to have a plurality of density measurement image patterns having different image printing ratios. Here, it is sufficient to have five to eight images having different image printing ratios. Therefore, when the image size and the maximum number of images are considered together, the pattern image size is 15 mm×8=120 mm, so that it can be made less than half the size of an A4 sheet (having a length of 297 mm), which is ordinarily used for printing.

When the transfer belt 61 rotates once and the next position reference signal (Top 2) is detected, the supporter 5 rotates, so that the developing device is switched to a third-color or cyan developing device (supporter rotation Cr). Then, a third-color or cyan density/tone control image exposure (image exposure Cexp) is carried out. In order to carry out the density/tone controlling operations, toner images of the various colors should not superimposed upon each other. Therefore, the image exposures are carried out by adjusting them to locations where the first-color or yellow density measurement image pattern and the second-color or magenta density measurement image pattern (indicated by slanted lines in FIG. 5) that have already been formed on the transfer belt 61 are not formed. Since, when a developing device is being switched to another developing device, the transfer belt 61 moves, an area that cannot be subjected to printing inevitably is formed between the yellow image pattern and the magenta image pattern. By making this area the printing area with cyan toner, toner images can be formed without any unwanted gaps over the entire transfer belt 61 in the direction of movement of the transfer belt 61, so that a larger number of detection images can be printed.

After the exposed image has been developed using cyan toner (development step Cdev), the cyan developing device is switched to a fourth-color or black developing device by the rotation of the supporter 5 (supporter rotation Kr). A fourth-color or black density/tone control image exposure (image exposure Kexp) is carried out by adjusting it to a location where the first-color or yellow density measurement image pattern and the second-color or magenta density measurement image pattern that have already been formed on the transfer belt 61 are not formed. Then, the exposed image is developed using black toner (development step Kdev). In this way, in the second rotation (and subsequent rotations), a pattern is formed in an area other than an area where another pattern has already been formed. After the toner images of the four colors have been formed and the densities of the images have been detected by the density sensor 9, a portion of any remaining toner image is cleaned off by a cleaner 67 as when ordinary printing is carried out.

By correcting the high-pressure conditions for charging, developing, transfer, etc. based on the detection results output from the density sensor 9, the engine controlling unit 202 makes adjustments to obtain an intended image density.

After executing the above-described sequence, tone control halftone patterns are formed by similarly executing the sequence. Then, the density sensor detects their densities. By adjusting an image data conversion table in the image processing unit 201 based on the detection of the densities of the tone control patterns, the density characteristics of the output images with respect to image data are adjusted so that they become linear.

As described above, the time required to complete the density control sequence is shortened because, in order to form detection images of four colors, the transfer belt 61 only needs to rotate twice in the embodiment, whereas it needs to rotate four times in the related example.

When the tone control sequence is executed after the density control sequence, the effect is doubled.

(Second Embodiment)

Figure 6:
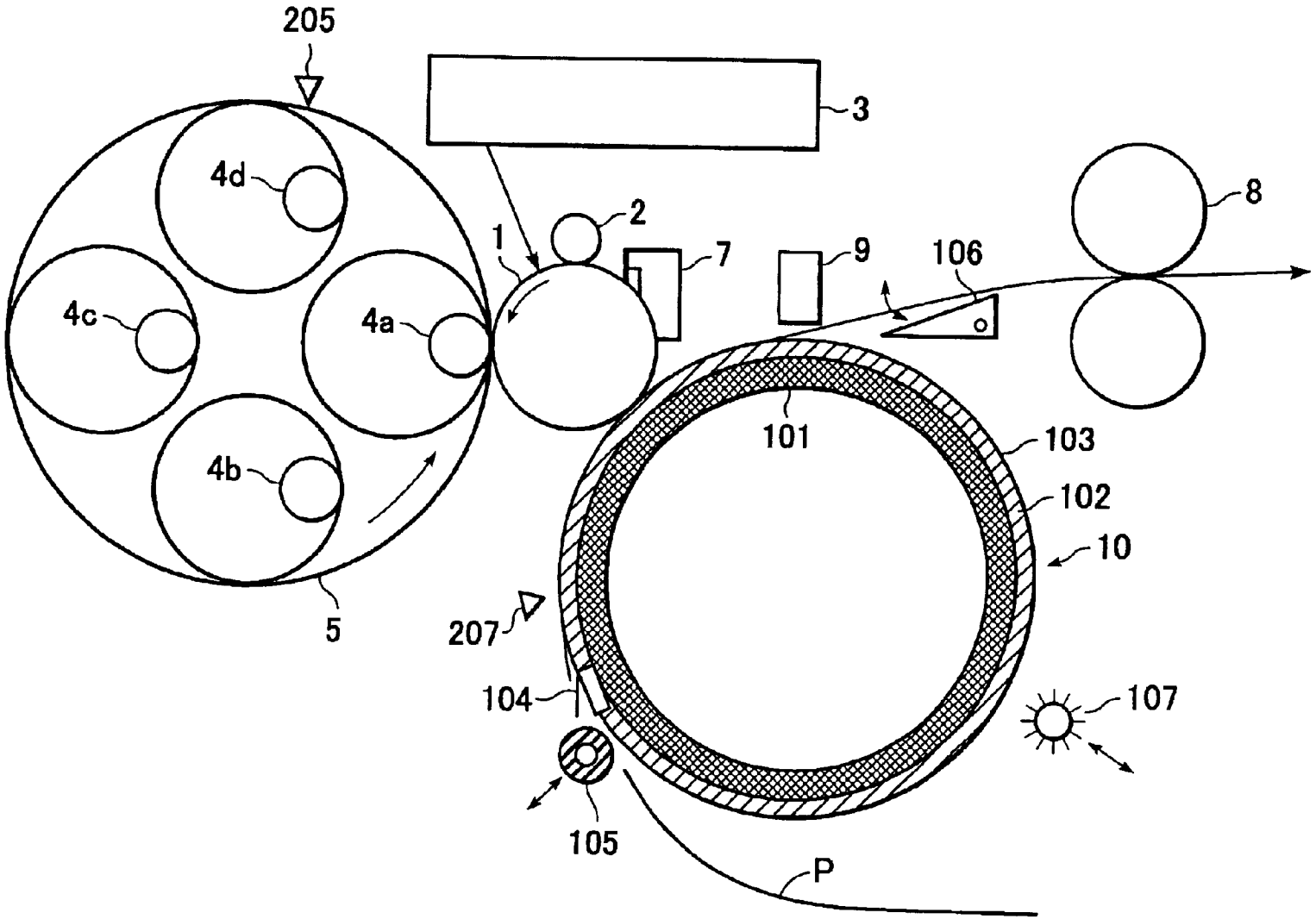
FIG. 6 is a sectional view of a color image forming apparatus of a second embodiment of the present invention.

FIG. 6 illustrates a second embodiment of the present invention. The second embodiment relates to an image forming apparatus for forming a color image by successively transferring toner images of four colors onto a transfer material that is carried by a transfer material carrier.

In the second embodiment, components having the same structure and operating in the same way as the corresponding components used in the first embodiment are given the same reference numerals and will be described below. Reference numeral 10 denotes a transfer drum serving as a transfer material carrier. In the transfer drum 10, an electrically conductive sponge layer 102 is formed on an electrically conductive supporter 101 to which a transfer bias voltage is applied, and a dielectric layer 103, such as a PVdF layer, is formed as the surface layer of the transfer drum 10. An end of a transfer material P that has been transported is carried by a gripper 104 that is disposed at the transfer drum 10. The transfer material P is electrostatically attracted and fixed to the transfer drum 10 by a roller 105 to which a predetermined bias voltage is applied. A first-color toner image that is formed on a photosensitive drum 1 as in the first embodiment is transferred onto the transfer material P in synchronism with the movement of the transfer drum 10. Thereafter, a toner image of a second color, etc., are developed and transferred by the steps like those carried out in the first embodiment. After the toner images of four colors have been transferred, the transfer material P is separated from the transfer drum 10 by passing a separation pawl 106 that can move in the direction of an arrow marked beside it in FIG. 6, and the images are fixed to the transfer material P by a fixing device 8. Reference numeral 107 denotes a cleaner, such as a fur brush, which can come into contact with and separate from the transfer drum 10 by moving in the directions of a double-headed arrow marked beside it in FIG. 6. The cleaner 107 cleans the transfer drum 10.

As in the previous embodiment, a position reference member is disposed at the transfer drum 10. An image formation sequence is controlled in accordance with position reference signals from the position reference member. The steps of forming an image of one color are carried out each time the transfer drum 10 rotates once. An image formation printing sequence in terms of the position reference signals, image exposures, development steps, and rotations of a supporter 5 is the same as that shown in FIG. 5.

Reference numeral 9 denotes a density sensor for detecting the densities of density/tone control toner images formed on the transfer drum 10, and has a structure that is similar to that of the density sensor 9 shown in FIG. 3. In the second embodiment, density measurement image patterns are directly transferred onto the transfer drum 10 because a separate transfer material is not required.

In this embodiment also, as in the sequence shown in FIG. 5, density/tone controlling operations are carried out for two colors during the time in which the transfer drum 10 rotates once. After density/tone controlling operations have been carried out for four colors, a portion of any tone image remaining on the transfer drum 10 is cleaned off by the cleaner 107.

As can be understood from the foregoing description, even in an apparatus which forms a color image by successively transferring toner images of four colors onto a transfer material that is carried by a carrier, it is possible to reduce the time required to complete the density/tone controlling operations by carrying out the density/tone controlling operations for two colors during the time in which the transfer drum rotates once (that is, the time in which the steps of forming an image of one color are carried out).

(Third Embodiment)

Figure 7:
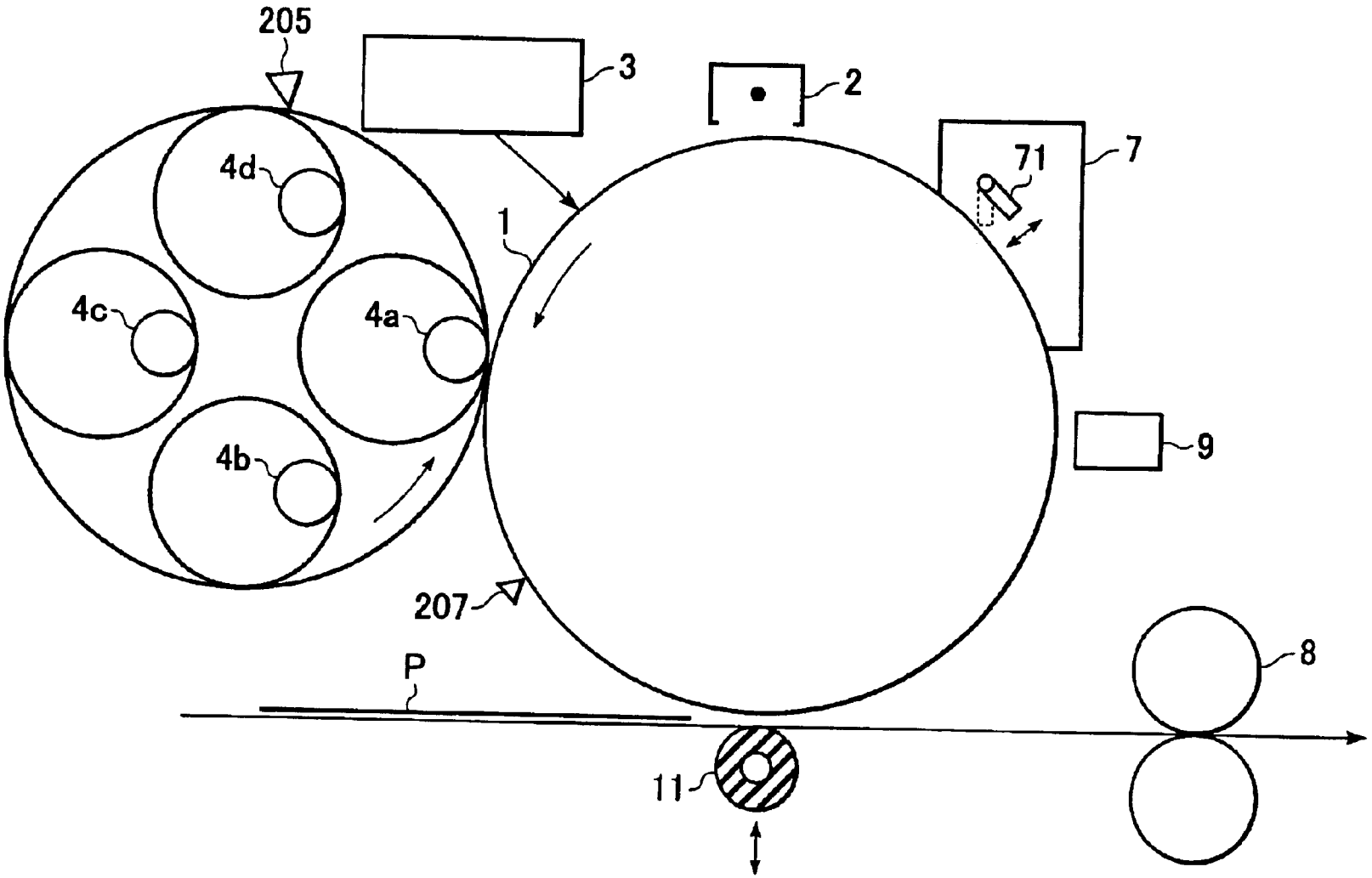
FIG. 7 is a sectional view of a color image forming apparatus of a third embodiment of the present invention.

FIG. 7 illustrates a third embodiment of the present invention. The third embodiment relates to an image forming apparatus for forming a color image by forming toner images of four colors on an electrostatic latent image carrier by successively repeating exposure and development operations, and by transferring the toner images of the four colors that are formed on the electrostatic latent image carrier onto a transfer material.

In the third embodiment, components having the same structure and operating in the same way as the corresponding components used in the first embodiment are given the same reference numerals and will not be described below. Reference numeral 1 denotes a photosensitive drum. Its peripheral length is equal to or greater than the sum of the length of an image to be printed and a length corresponding to the amount of time required to switch to a different developing device. Reference numeral 2 denotes a charger for charging the photosensitive drum 1. Here, since it is necessary to charge the photosensitive drum 1 that carries toner images, it is desirable that the charger be a noncontact charger such as a coroner charger.

The steps of forming images will be simply described below. The photosensitive drum 1 is driven by driving means (not shown) in the direction of an arrow marked on the photosensitive drum 1 in FIG. 7 and is uniformly charged to a predetermined voltage by a roller charger 2. The photosensitive drum 1 is an electrostatic latent image carrier comprising an aluminum cylinder having an organic photosensitive material (OPC) or a photoconductive material (such as A—Si, CdS, or Se) applied to the outer peripheral surface thereof. Next, an exposure device 3 scans the photosensitive drum 1 using light that is based on a signal that is generated in accordance with a yellow image pattern in order to form a latent image on the photosensitive drum 1. When the photosensitive drum 1 rotates further in the direction of the arrow, a supporter 5 rotates so that, of developing devices 4*a*, 4*b*, and 4*c*, which are supported by the supporter 5, the developing device 4*a* containing yellow toner opposes the photosensitive drum 1. Then, the latent image is made visible by the selected developing device 4*a*. After the latent image has been developed with yellow (first color) toner, the photosensitive drum 1 is uniformly charged again by the charger 2. Then, a second-color or magenta exposure is carried out by the exposure device 3. By the time a magenta exposure portion has reached a development position, the supporter 5 has rotated so that the developing device 4*b* is at the development position, where another latent image is developed. By developing latent images with cyan and black toner, toner images of a plurality of colors are formed on the photosensitive drum 1. When the toner images of the four colors are formed on the photosensitive drum 1, a transfer material P is transported in synchronism with the movement of the photosensitive drum 1. Then, a transfer roller 11 comes into contact with the photosensitive drum 1 through the transfer material P, and a bias voltage is applied to the transfer roller 11 from a high-voltage power supply (not shown), thereby transferring the toner images of the four colors that are formed on the photosensitive drum 1 onto the transfer material P. The toner images of the four colors that have been transferred on the transfer material P are fused and fixed by a related fixing device 8 that heats and presses the images. A portion of any toner image remaining on the photosensitive drum 1 is cleaned off by a cleaner 7. As shown in FIG. 7, a cleaning blade 71 of the cleaner 7 has a structure which allows it to come into contact with (indicated by a dotted line) and separate from (indicated by a solid line) the photosensitive drum 1. The cleaning blade 71 is separated from the photosensitive drum 1 unless it is not cleaning the photosensitive drum 1.

As in the previous embodiments, a position reference member is disposed at the photosensitive drum 1. In accordance with position reference signals from the position reference member, the colors are brought into register, and an image formation sequence is controlled. In the third embodiment, the steps of forming an image of one color are carried out each time the photosensitive drum 1 rotates once. The image formation sequence in terms of position reference signals, image exposures, development steps, and rotations of the supporter 5 is the same as that shown in FIG. 5.

Reference numeral 9 denotes a density sensor for detecting the densities of density/tone control toner images formed on the transfer drum 1, and has a structure that is similar to that of a related density sensor. In this embodiment also, as in the sequence shown in FIG. 2, density/tone controlling operations are carried out for two colors during the time in which the transfer drum 1 rotates once. After density/tone controlling operations for four colors have been carried out, a portion of any tone image remaining on the transfer drum 1 is cleaned off by the cleaner 7.

As can be understood from the foregoing description, even in an apparatus which forms a color image by successively exposing the photosensitive drum and developing latent images on the photosensitive drum with toner of four colors, it is possible to reduce the time required to complete the density/tone controlling operations by carrying out the density/tone controlling operations for two colors during the time in which the photosensitive drum rotates once (that is, the time in which the steps of forming an image of one color are carried out).

Although, in the above-described embodiments, a description of the case where the density/tone control patterns of two colors are formed during the time the steps of forming an image of one color are carried out is given, it is obvious that density/tone control patterns of three or more colors may be formed.

As described above, in a color image forming apparatus of the present invention for forming images of a plurality of colors by repeating the steps of forming an image of one color, when density/tone controlling operations are carried out by forming density detection images, density/tone controlling operations for a plurality of colors are carried out during the time the steps of forming an image of one color are carried out, thereby making it possible to reduce the time required to complete the density/tone controlling operations. In addition, by disposing a detection image formed during the subsequently carried out steps of forming an image of one color between the detection images of a plurality of colors that have been formed during the steps of forming an image of one color, it is possible to sufficiently use the peripheral portion of the detection image carrier and to form a larger number of detection images.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A color image forming apparatus comprising:

an image forming unit for forming an image of any of a plurality of colors;

a carrier for carrying the image formed by the image forming unit; and a density detector adapted for detecting the density of the image on the carrier; and a controlling unit adapted for controlling the image forming unit so that density detection pattern images of different colors included in the any of the plurality of colors for detection by the density detector are formed within a period of time in which the carrier rotates once.

2. A color image forming apparatus according to claim 1, wherein the controlling unit controls the image forming unit so that an ordinary image of one color is formed within the period of time in which the carrier rotates once.

3. A color image forming apparatus according to claim 1, further comprising a first adjusting unit adapted for adjusting an electrophotographic processing device based on a detection by the density detector.

4. A color image forming apparatus according to claim 3, further comprising a second adjusting unit adapted for adjusting an image data conversion condition based on a detection by the density detector.

5. A color image forming apparatus according to claim 1, wherein the image forming unit comprises an exposure unit adapted for forming an electrostatic latent image, and a developing unit for developing the electrostatic latent image using the any of the plurality of colors.

6. A color image forming apparatus according to claim 5, further comprising a position detector adapted for detecting the position of the image carrier, wherein the controlling unit controls a timing in which the exposure unit forms the latent image based on a detection by the position detector.

7. A color image forming apparatus according to claim 1, wherein the carrier is an intermediate transfer member, and wherein the image forming unit forms a toner image on a photosensitive member in order to transfer the toner image onto the intermediate transfer member.

8. A color image forming apparatus according to claim 1, wherein the carrier is a transfer material holder, and wherein, when an ordinary image is to be formed, the image forming unit forms a toner image on a photosensitive member in order to transfer the toner image disposed on the photosensitive member onto a transfer material held by the transfer material holder, whereas, when a density detection pattern image is to be formed, a toner image is formed on the photosensitive member in order to transfer the toner image disposed on the photosensitive member onto the transfer material holder.

9. A color image forming apparatus according to claim 1, wherein the carrier is a photosensitive member, and wherein the image forming unit transfers images of the plurality of colors onto the photosensitive member by superimposing them upon each other.

10. A color image forming apparatus according to claim 1, wherein the controlling unit controls the image forming unit so that density detection pattern images of two colors included in the any of the plurality of colors for detection by the density detector are formed within the period of time in which the carrier rotates once.

11. A color image forming apparatus according to claim 1, wherein the controlling unit controls the image forming unit so that, in the second and subsequent rotations of the carrier, the density detection pattern images are formed in an area other than an area where the image has already been formed.

12. A color image forming apparatus comprising:

an image forming unit for forming an image of any of a plurality of colors;

a carrier for carrying the image formed by the image forming unit; and a density detector adapted for detecting the density of the image on the carrier; and a controlling unit adapted for switching between colors in the image forming unit in a period of time that is different from a period of time in which an ordinary image is formed, when a density detection pattern image for detection by the density detector is to be formed.

13. A color image forming apparatus according to claim 12, wherein, when the density detection pattern image for detection by the density detector is to be formed, the controlling unit switches between the colors in the image forming unit in a period of time that is shorter than the period of time in which the ordinary image is formed.

14. A color image forming apparatus according to claim 12, further comprising a first adjusting unit adapted for adjusting an electrophotographic processing device based on a detection by the density detector.

15. A color image forming apparatus according to claim 14, further comprising a second adjusting unit adapted for adjusting an image data conversion condition based on a detection by the density detector.

16. A color image forming apparatus according to claim 12, wherein the image forming unit comprises an exposure unit adapted for forming an electrostatic latent image, and a developing unit for developing the electrostatic latent image using the any of the plurality of colors.

17. A color image forming apparatus according to claim 16, further comprising a position detector adapted for detecting the position of the image carrier, wherein the controlling unit controls a timing in which the exposure unit forms the latent image based on a detection by the position detector.

18. A color image forming apparatus according to claim 12, wherein the carrier is an intermediate transfer member, and wherein the image forming unit forms a toner image on a photosensitive member in order to transfer the toner image onto the intermediate transfer member.

19. A color image forming apparatus according to claim 12, wherein the carrier is a transfer material holder, and wherein, when an ordinary image is to be formed, the image forming unit forms a toner image on a photosensitive member in order to transfer the toner image disposed on the photosensitive member onto a transfer material held by the transfer material holder, whereas, when a density detection pattern image is to be formed, a toner image is formed on the photosensitive member in order to transfer the toner image disposed on the photosensitive member onto the transfer material holder.

20. A color image forming apparatus according to claim 12, wherein the carrier is a photosensitive member, and wherein the image forming unit transfers images of the plurality of colors onto the photosensitive member by superimposing them upon each other.

21. A color image forming apparatus according to claim 12, wherein the controlling unit controls the image forming unit so that density detection pattern images of two colors included in the any of the plurality of colors for detection by the density detector are formed within the period of time in which the carrier rotates once.

22. A color image forming apparatus according to claim 12, wherein the controlling unit controls the image forming unit so that, in the second and subsequent rotations of the carrier, the density detection pattern image is formed in an area other than an area where the image has already been formed.

* * * * *

UNITED STATES PATENT AND TRADEMARK OFFICE

CERTIFICATE OF CORRECTION

PATENT NO. : 6,847,790 B2
DATED : January 25, 2005
INVENTOR(S) : Tatsuya Kobayashi et al.

It is certified that error appears in the above-identified patent and that said Letters Patent is hereby corrected as shown below:

Column 3,
Line 13, “is” should read -- are --.

Column 4,
Line 62, “superimposed” should read -- be superimposed --.

Column 8,
Line 50, “and” should be deleted.

Column 9,
Line 51, “and” should be deleted.

Signed and Sealed this

Thirty-first Day of May, 2005

JON W. DUDAS
*Director of the United States Patent and Trademark Office*